US011939727B2

(12) United States Patent
Barezzani et al.

(10) Patent No.: US 11,939,727 B2
(45) Date of Patent: Mar. 26, 2024

(54) RAIL TOOL-HOLDER CART

(71) Applicant: Cembre S.p.A., Brescia (IT)

(72) Inventors: Gualtiero Barezzani, Brescia (IT); Gianluca Giacomazzi, Brescia (IT)

(73) Assignee: Cembre S.p.A., Brescia (IT)

( * ) Notice: Subject to any disclaimer, the term of this patent is extended or adjusted under 35 U.S.C. 154(b) by 1085 days.

(21) Appl. No.: 16/636,980

(22) PCT Filed: Jul. 18, 2018

(86) PCT No.: PCT/IB2018/055331
§ 371 (c)(1),
(2) Date: Feb. 6, 2020

(87) PCT Pub. No.: WO2019/030590
PCT Pub. Date: Feb. 14, 2019

(65) Prior Publication Data

US 2020/0240088 A1 Jul. 30, 2020

(30) Foreign Application Priority Data

Aug. 7, 2017 (IT) ..... 102017000091285

(51) Int. Cl.

| | |
|---|---|
| ***E01B 31/04*** | (2006.01) |
| ***E01B 31/24*** | (2006.01) |
| *B61D 15/00* | (2006.01) |
| *E01B 11/46* | (2006.01) |
| *E01B 29/16* | (2006.01) |
| *E01B 31/18* | (2006.01) |

(52) U.S. Cl.
CPC ..... *E01B 31/04* (2013.01); *E01B 31/24* (2013.01); *B61D 15/00* (2013.01); *E01B 11/46* (2013.01); *E01B 29/16* (2013.01); *E01B 31/18* (2013.01)

(58) Field of Classification Search
CPC ..... E01B 31/04; E01B 31/24; E01B 11/46; E01B 29/16; E01B 31/18; B61D 15/00
See application file for complete search history.

(56) References Cited

U.S. PATENT DOCUMENTS

| | | | | |
|---|---|---|---|---|
| 1,652,881 A | | 12/1927 | Viezzi | |
| 2,118,621 A | * | 5/1938 | Perazzoli | E01B 31/17 451/347 |
| 2,732,173 A | | 1/1956 | Hursh | |
| 3,772,830 A | | 11/1973 | Hambrick | |
| 3,883,323 A | * | 5/1975 | Cooley | E01B 31/17 451/347 |

(Continued)

FOREIGN PATENT DOCUMENTS

| | | |
|---|---|---|
| DE | 505 755 C | 8/1930 |
| DE | 11 15 754 B | 10/1961 |

(Continued)

*Primary Examiner* — Scott A Browne
(74) *Attorney, Agent, or Firm* — Blank Rome LLP

(57) ABSTRACT

A rail tool-holder cart (1) comprises a "T"-shaped support frame (2), a tool-holder arm, (12) rotatable about a vertical axis and tiltable between an upper position and a lower position and having a coupling interface for a tool (17, 17'), a spring (19), which pushes the tool-holder arm permanently towards the upper position, so as to compensate at least one part of the weight of the tool (17, 17'), as well as adjustment means (20) for adjusting the spring thrust (19).

26 Claims, 8 Drawing Sheets

(56) References Cited

U.S. PATENT DOCUMENTS

| | | | | |
|---|---|---|---|---|
| 6,669,533 | B2 * | 12/2003 | Huboud-Peron | E01B 31/17 451/24 |
| D923,904 | S * | 6/2021 | Barezzani | D34/23 |
| 2005/0244585 | A1 | 11/2005 | Schmeling | |

FOREIGN PATENT DOCUMENTS

| | | | |
|---|---|---|---|
| FR | 1 383 595 | A | 12/1964 |
| FR | 2 543 985 | A1 | 10/1984 |

* cited by examiner

RAIL TOOL-HOLDER CART

A rail tool-holder cart forms the object of the present invention.

Powerful drills and screwdrivers, thus with an elevated weight, are used for the drilling of wooden railway sleepers and for the fixing of rail profiles between one another and onto the sleepers. To reduce the strain and risk of injury to users caused by the elevated weight of the tools used, the use of a rail tool-holder cart is known, resting on the rails, which is pushed manually along the rails and supports the tool during use, counterbalancing one part of the weight thereof.

A known rail tool-holder cart comprises:

an "L"-shaped support frame with rollers for resting the support frame on the rails, a tool-holder arm rotatably connected to the support frame about a vertical rotation axis in an angular range of about 180°, and having a connection portion for a removable connection of a tool, wherein the support arm forms a deformable/hinged parallelogram or four-point-articulation on a vertical plane so as to allow a vertical translation of the connection portion, and consequently, of the tool coupled thereto, with respect to the support frame, between an upper limit position and a lower limit position, a gas spring (or a gas spring with a shock-absorber) connected to the parallelogram or four-point-articulation, which stresses the connection portion permanently towards the upper limit portion, so as to compensate for at least one part of the weight of the tool.

Despite the undoubted usefulness of the rail tool-holder carts of the prior art, they nonetheless have various drawbacks.

The "L" shape of the support frame does not allow a positioning of the tool-holder arm outside the angular range of 180° without a high risk of the whole cart overturning.

The fixed angular range of 180° undesirably limits the maneuverability of the tool and slows down, for example the acquisition and changing of different work positions, for example on an outer side of the rails and on front and rear sides with respect to the advancement direction of the work along the railway line.

The thrust exerted by the gas spring counterbalances the weight of only one type of tool accurately and the use of different tools with different weights requires that the user has to compensate manually for a thrust excess of the spring upwards or a gravitational thrust excess of the tool downwards.

Consequently, it is an object of the present invention to provide a rail tool-holder cart having such features as to overcome at least some of the drawbacks described with reference to the prior art.

Such object is achieved with a rail tool-holder cart, comprising:

a support frame having:

a longitudinal beam having two opposite end portions on each of which a roller is mounted for a rolling support of the support frame at two separate points on a first rail, a cross rod having a connection end rigidly connected to the longitudinal beam in a center position or center region between the two end portions, and a support end opposite the connection end and on which at least one wheel is mounted for a rolling support of the support frame in at least one point on a second rail, transversely separate from the first rail, a tool-holder arm comprising:

a turret portion connected to the support frame adjacent to the connection end of the cross rod and rotatable with respect to the support frame about a substantially vertical rotation axis in an open unlimited angular range, a coupling interface for a removable connection of a tool, an arm extended transversely to the vertical rotation axis and connecting the coupling interface to the turret portion so that the coupling interface rotates together with the turret portion about the vertical rotation axis and is vertically movable with respect to the support frame between an upper limit position and a lower limit position, a spring exerting on the coupling interface a permanent thrust towards the upper limit position so as to compensate for at least a part of the weight of the tool, adjustment means for adjusting the spring thrust on the coupling interface.

Due to the T-shaped configuration of the support frame, it allows a rotation of the tool-holder arm of 360° without the risk of the cart overturning. Due to the unlimited free rotation, thus without a stroke-end stop position, of the tool-holder arm, the user can move quickly and easily into any work position (outer, inner, front, rear) along the rails. This positioning freedom of the tool-holder arm, together with the possibility of adjusting the intensity of the vertical thrust of the spring, allow ergonomic work postures and movements (and therefore less strenuous), which are also quick.

For a better understanding of the invention and to appreciate the advantages thereof, some non-limiting embodiments will be described below by way of example, with reference to the appended figures, wherein.

Figure 1:
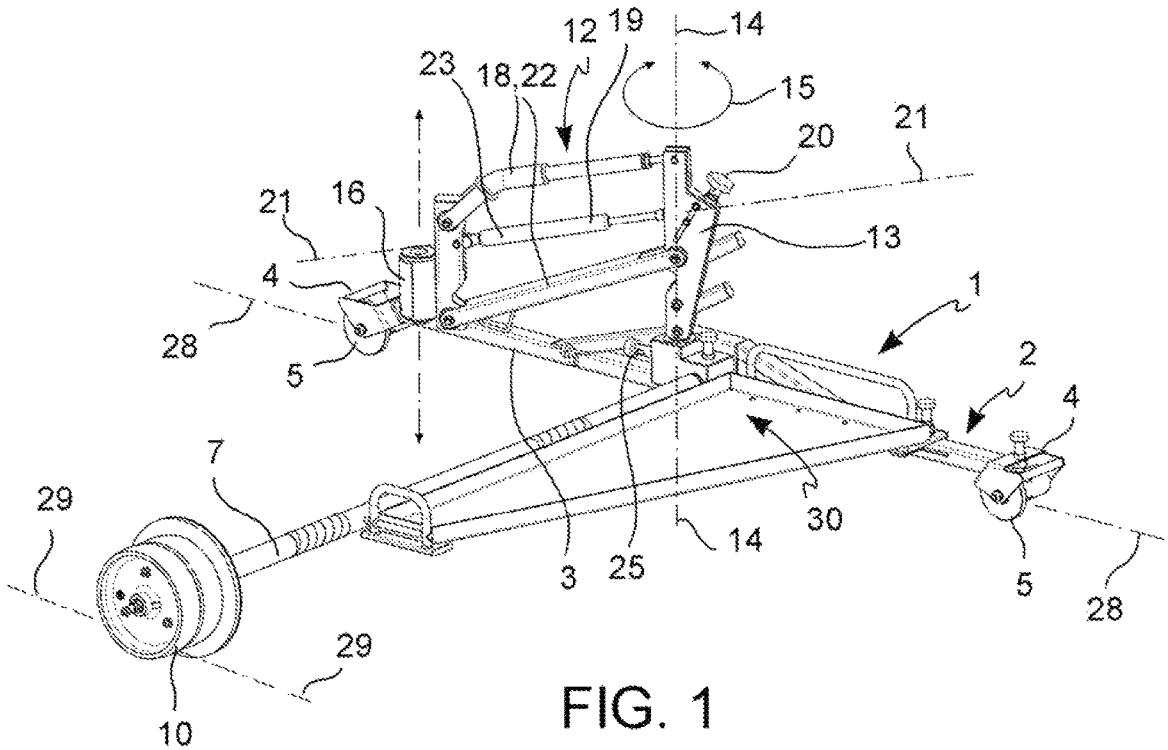
FIG. 1 is a perspective view of a rail tool-holder cart according to one embodiment of the invention.

With reference to the figures, a rail tool-holder cart 1 comprises a support frame 2 having:

- a longitudinal beam 3 having two opposite end portions 4 on each of which a roller 5 is mounted for a rolling support of the support frame 2 in two separate points on a first rail 6,
- a cross rod 7 having a connection end 8 rigidly connected to the longitudinal beam 3 in a center position or center region between the two end portions 4, and a support end 9 opposite the connection end 8 and on which at least one wheel 10 (FIG. 2), 5' (FIG. 3), 5" (FIG. 18) is mounted for a rolling support of the support frame 2 in at least one point on a second rail 11, transversely spaced from the first rail 6.

The rail tool-holder cart 1 further comprises a tool-holder arm 12 comprising:

- a turret portion 13 connected to the support frame 2 adjacent to the connection end 8 of the cross rod 7 and rotatable with respect to the support frame 2 about a substantially vertical rotation axis 14 in an unbounded open angular range 15,
- a coupling interface (or portion) 16 for a removable connection of a tool 17, 17',
- an arm 18 extended transversely to the vertical rotation axis 14 and which connects the coupling interface 16 to the turret portion 13 so that the coupling interface 16 rotates together with the turret portion 13 about the vertical rotation axis 14 and is vertically movable with respect to the support frame 2 between an upper limit position and a lower limit position (vertical arrows in FIG. 1), The rail tool-holder cart 1 further comprises a spring 19 exerting on the coupling interface 16 a permanent thrust towards the upper limit position so as to compensate for at least one part of the weight of the tool 17, 17', as well as adjustment means 20 for adjusting the spring thrust 19 on the coupling interface 16.

By virtue of the T-shaped configuration of the support frame 2, it allows a rotation of 360° of the tool-holder arm 12 without the risk of the cart 1 overturning. Due to the unlimited free rotation, thus without a stroke-end stop position, of the tool-holder arm 12, the user can move the tool 17, 17' quickly and easily into any (outer, inner, front, rear) work position along the rails 6, 11. This positioning freedom of the tool-holder arm 12, together with the possibility of adjusting the intensity of the vertical thrust of the spring 19, allows more ergonomic work postures and movements (and therefore less strenuous), which are also quicker.

In accordance with one embodiment, the tool-holder arm 12 comprises a structure of rigid rods hinged to one another, for example a deformable/hinged parallelogram, or four—point—articulation, which is deformable on a vertical deformation plane, so as to make and guide the vertical translation of the coupling interface 16 with respect to the support frame 2.

According to a further embodiment, the spring 19 is interposed in a pre-compressed configuration between the turret portion 13 and the coupling interface 16, for example with an elastic thrust direction or axis 21, which is inclined with respect to a longitudinal direction of one or more rods 22 of the structure of articulated rigid rods of the arm 18.

The spring 19 can comprise a metal spring, for example helicoidal, or a gas spring, to which a shock-absorber 23 can be coupled, in series or parallel, in order to prevent uncontrolled movements of the tool-holder arm 12 in the event of decoupling of a particularly heavy tool 17.

According to one embodiment, the adjustment means 20 can comprise means, for example with a screw 24 or ferrule, for adjusting the pre-compression intensity of the spring 19 or for adjusting the position or orientation of the spring with respect to the arm 18 and/or with respect to the turret portion 13 and to the coupling interface 16.

In one preferred embodiment, the spring 19 or the spring 19—shock absorber 23 assembly comprises a first end connected to the turret portion 13, and a second end connected to a portion, which forms or comprises the coupling interface 16, wherein the adjustment means 20 are adapted to vary the vertical connection position of the first and/or second end, so as to adjust the inclination of the thrust direction 21.

In accordance with an embodiment, the turret portion 13 and therewith, the entire tool-holder arm 12, is rotatable about the vertical rotation axis 14 in both rotation directions and in an unhindered manner.

Figure 2:
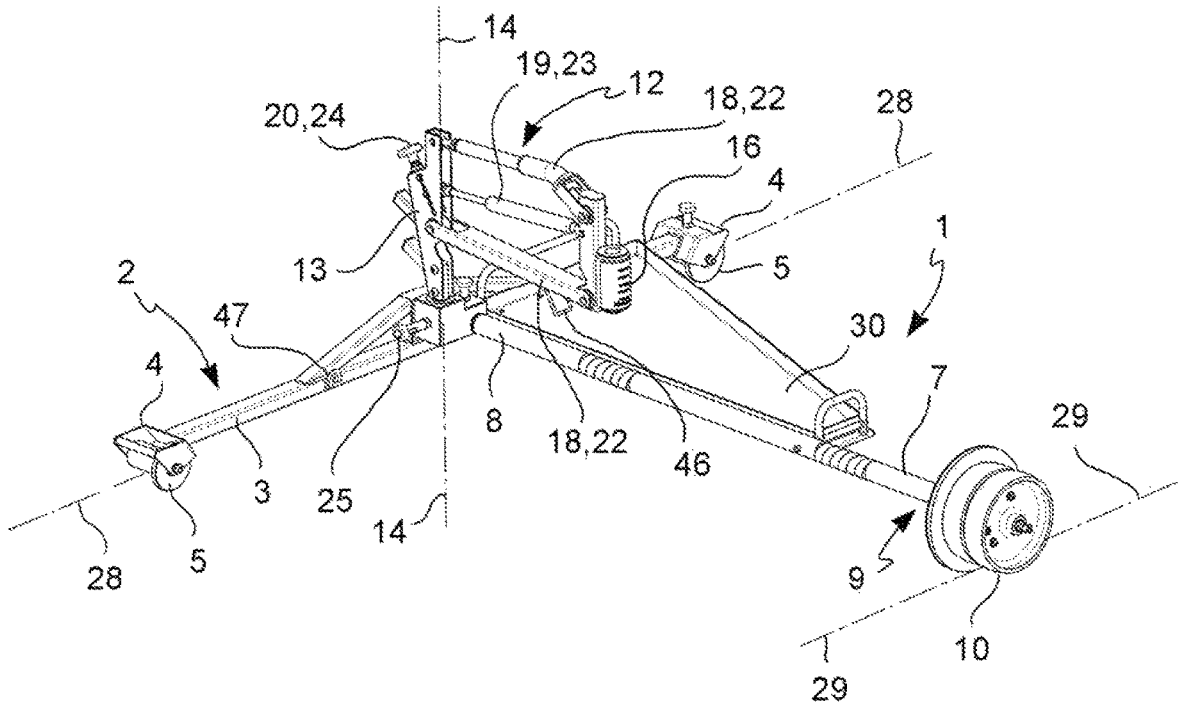
FIG. 2 is a further perspective view of the rail tool-holder cart in FIG. 1.

According to an embodiment, the cart 1 comprises stop means 25 operable to lock the tool-holder arm 12 in one or more predetermined angular positions (referring to the rotation about the vertical rotation axis 14), in order to allow a stop and/or certain positioning in particularly useful and/or frequently requested tool-holder arm 12 positions, for example in an advancement position, wherein the tool-holder arm 12 is turned towards the support end 9 of the cross rod 7 and preferably substantially aligned (in view from above) with the cross rod 7 (FIG. 2). In this advancement position, the cart 1 can easily be pushed along the track, manually gripping the locked tool-holder arm 12 and pushing it forwards.

The stop means 25 can comprise one or more stop cavities 27 formed in the turret position 13, and a stop pin 26 received in the support frame 2 and movable (for example rotatable) from:

- a rest position, wherein the stop pin 26 is not movable in engagement with the stop cavity 27, and
- a work position, wherein the stop pin 26 is elastically stressed and movable to engage in said stop cavity 27.

According to one embodiment, the vertical rotation axis 14 is spaced from a first rail axis 28 defined by the rollers 5 towards a second rail axis 29 defined by the one or more wheels 10 in a misalignment range from 1/20 to 1/30 of the gauge (distance) between the first and second rail axes 28, 29. For example, the vertical rotation axis 14 is at a distance of 55 mm from the first rail axis 28 and the first rail axis 28 is about 1490 mm away from the second rail axis 29 with a misalignment of about 1/27.

In this way the center of gravity of the cart 1—tool 17, 17' assembly moves further into the space between the support points on the rails, allowing the counterweight of the wheel 10 to be reduced, and the length of the tool-holder arm 12 to be shortened, without reducing the range of action, to carry out the drilling and screwing between the two rails and externally thereto.

According to a further embodiment, the tool-holder cart 1 comprises an auxiliary platform 30 removably connected to the support frame 2, in particular to the longitudinal beam 3 and to the cross rod 7, and adapted to temporarily support a tool 17, 17' or other work material. The auxiliary platform 30 provides a deposit space, which allows the cart 1 to be used with more than one tool 17, 17' without having to manually carry the tools 17, 17' currently not coupled to the tool-holder arm 12.

According to one embodiment, the auxiliary platform 30 comprises a support plane 31 made of metal sheet, for example aluminum, with peripheral edges 32 bent upwards to reinforce the structure thereof and avoid the loss of small parts or other objects resting on the support plane 31. The auxiliary platform can also comprise two handles 33 positioned at two opposite edges and, preferably, connected to metal reinforcement profiles 34 connected at the opposite edges of the auxiliary platform 30.

The handles 33 favor the manual grip of the auxiliary platform 30, the coupling and decoupling thereof to the support frame 2 and a use thereof as a container for transporting material during the use of the cart 1.

For the removable coupling to the support frame 2, the auxiliary platform 30 can comprise

- a pin 35 (preferably at one of the two handles 33) adapted to be inserted in a through hole 36 of the support frame 2, preferably of the cross rod 7, as well as
- at least two tabs or latches 37 (preferably at the other of the two handles 33) insertable in corresponding slots 38 of the support frame 2, preferably of the longitudinal beam 3, as well as
- a locking member 39, for example a pin or a screw, adapted to lock the auxiliary platform 30 in the position mounted on the support frame 2.

This avoids the risk of accidental disengagement of the auxiliary platform 30 (for example in the event of vibrations) despite the removable coupling thereof.

Figure 10:
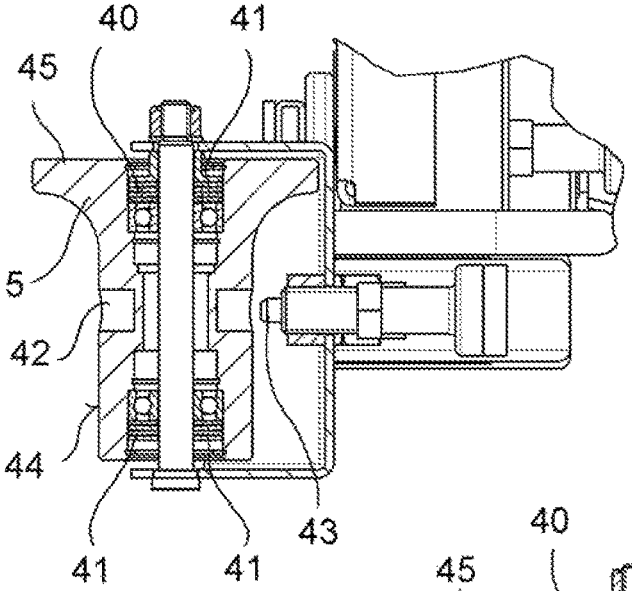
FIGS. 10 and 11 are section views of a support roller with a permanent braking system and with a locking system in a locking (FIG. 11) and unlocking (FIG. 10) configuration according to an embodiment.
Figure 11:
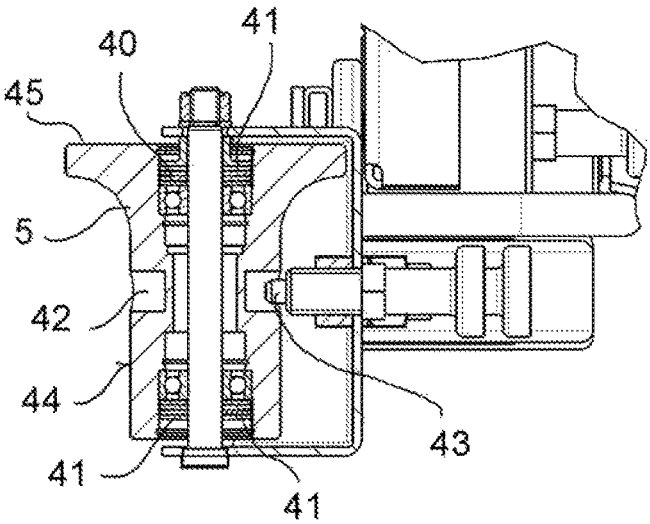

According to one embodiment, at least one of the rollers 5 has one or more recesses 42, preferably along a rolling surface thereof, engageable by a roller locking pin 43 connected to the support frame 2 or to the longitudinal beam 3 with the function of a parking lock or brake (FIGS. 10 and 11).

The roller locking pin 43 is received in the support frame 2 and movable (for example rotatable) from:

- a rest position, wherein the roller locking pin 43 is not movable in engagement with the recess 42, and
- a work position, wherein the roller locking pin 43 is elastically stressed and movable to engage in said recess 42.

Advantageously, the tool-holder cart 1 comprises a braking system 40, which exerts a braking force (in particular, a friction force) on the rollers 5 and/or on the wheel 10, which is permanent and adapted to slow down and stop movements of the cart 1 on tracks inclined up to 40 per thousand (o/oo), which may, however, be overcome by means of a manual thrust of the cart 1. Advantageously, the friction force is such that the cart 1, which moves on the rails at a speed of 6 Km/h stops within 10 meters (in the case of dry rails) and within 14 meters (on wet rails), inclined up to a maximum of 40 per thousand. This conciliates the need to be able to move the tool-holder cart 1 manually along the track with the need to prevent uncontrolled descents of the cart along slightly inclined tracks.

According to an embodiment, the braking system 40 comprises cup springs 41, inserted on roller 5 axes so as to make permanent friction between the rollers 5 and the support frame 2 (FIGS. 10, 11).

Figure 3:
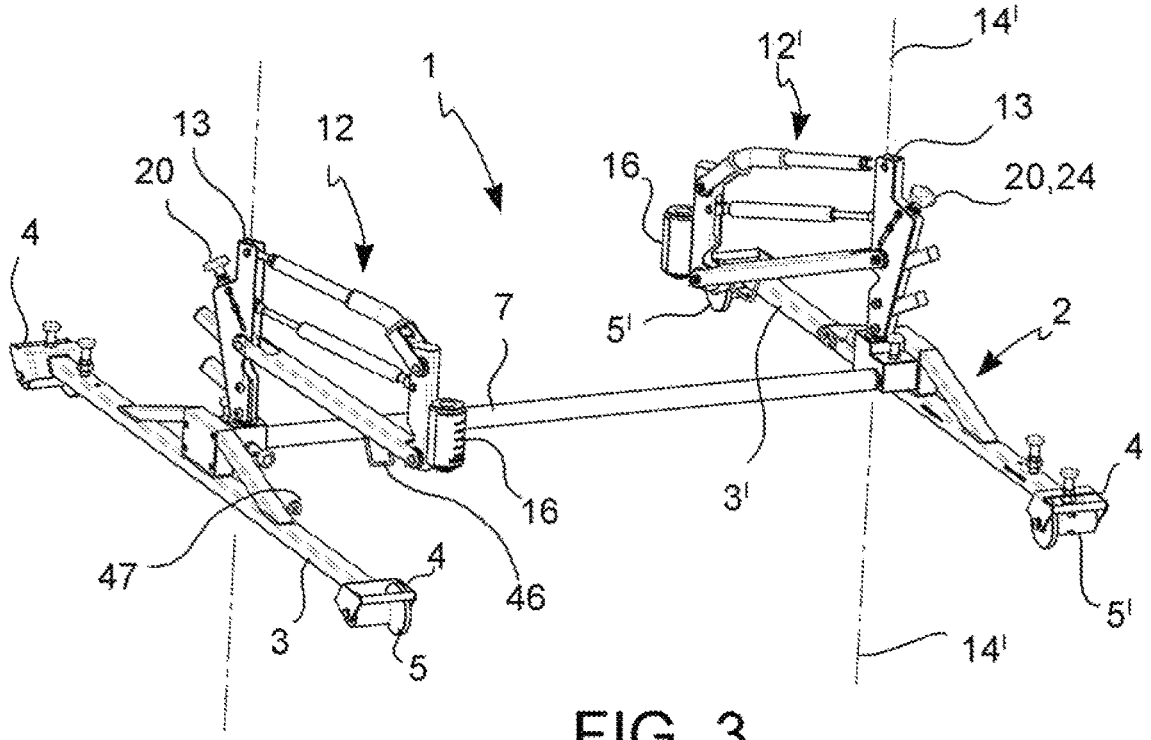
FIG. 3 is a perspective view of a rail tool-holder cart according to a further embodiment of the invention.

The rollers 5 form a substantially cylindrical rolling surface 44 and a single unilateral flange 45 on the side facing the inside of the track, so that the cart 1 can also be made to slide through exchanges without having to be lifted (FIG. 3).

Figure 5:
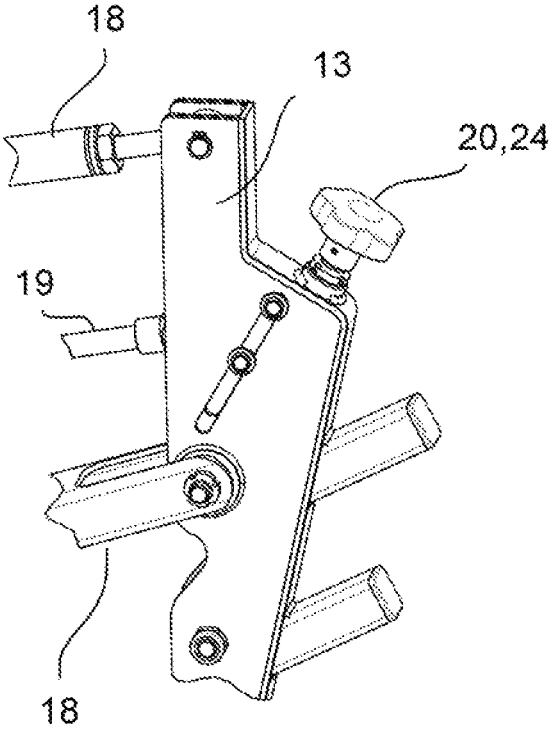
FIG. 5 illustrates a detail of an adjustment system for counterbalancing the weight of one tool according to one embodiment.
Figure 6:
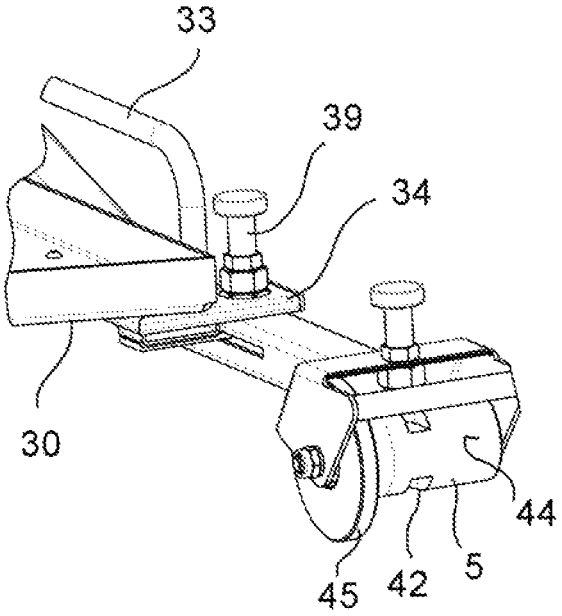
FIG. 6 illustrates a detail of a removable coupling system of an auxiliary platform of a cart according to one embodiment.
Figure 7:
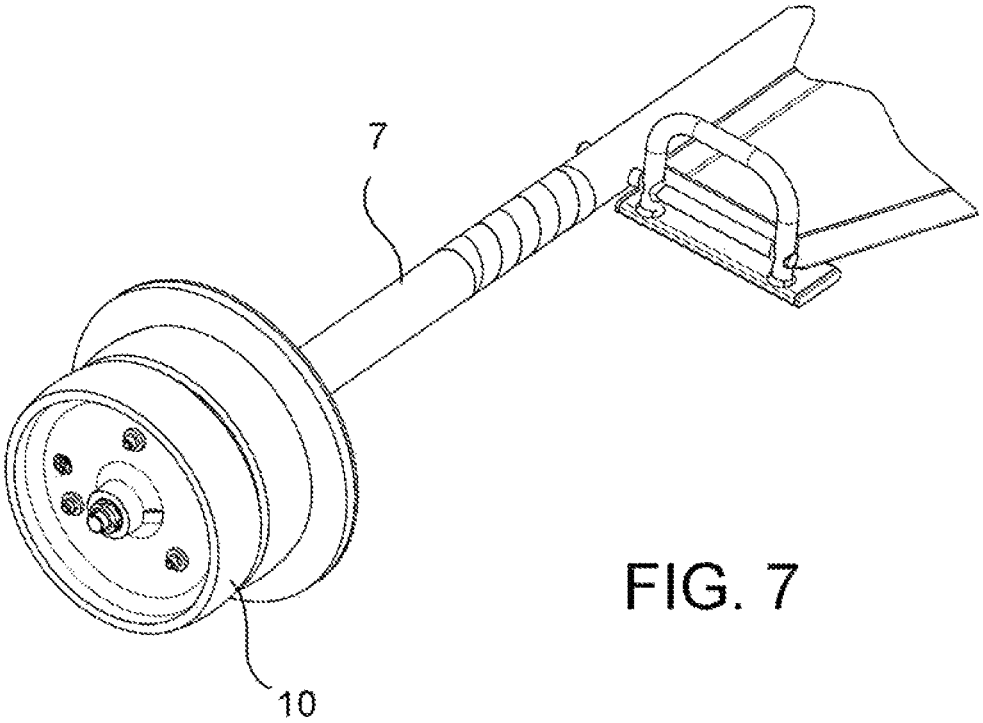
FIG. 7 illustrates a further detail of the removable coupling system for the auxiliary platform according to one embodiment.
Figure 8:
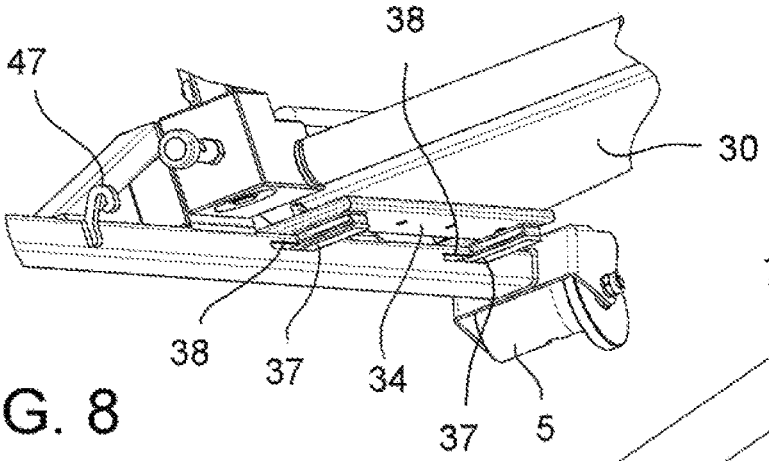
FIG. 8 illustrates an even further detail of the removable coupling system for the auxiliary platform according to one embodiment.
Figure 9:
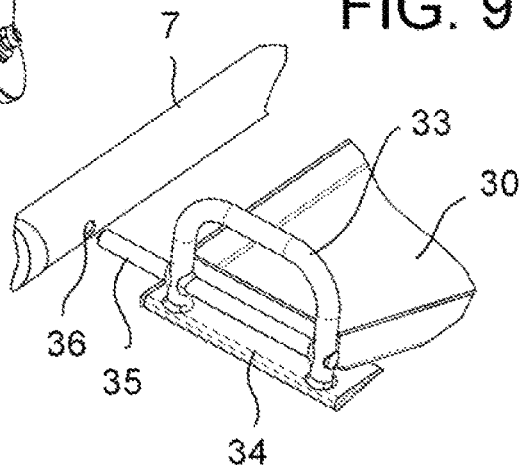
FIG. 9 illustrates the detail in FIG. 7 in a decoupled configuration.

According to a further embodiment, the cart 1, preferably the turret portion 13, forms a plurality of seats, for example rectangular, for receiving bushes for screwdrivers, drill bits or other tool accessories 17, 17' (FIGS. 1, 5).

The cross rod 7 can have an adjustable length, for example telescopic, and with means for locking the adjusted length, to allow a versatile adaptation of the cart 1 to tracks with a different rail gauge (not illustrated in the figures).

According to a further embodiment, the tool-holder arm 12 comprises a hooking portion 46 and the longitudinal beam 3 comprises a corresponding counter-hooking portion 47 engageable with each other to keep the tool-holder arm 12 in a compacted position, aligned with, and lowered towards the longitudinal beam 3. In this compacted position, the longitudinal beam 3—tool-holder arm 12 assembly (detached from the cross rod 7) can easily be transported manually, for example by gripping the arm 18.

According to a further embodiment, the longitudinal length of the longitudinal beam 3, including the rollers 5, is in the range from 0.85 to 1.15 times the length of the cross rod 7, including the wheel 10. Preferably, both pieces substantially have the same length. This minimizes the transport and storage space of the cart 1 in the disassembled configuration.

Advantageously, the cross rod 7, including the wheel 10, is also dimensioned so that it can be carried manually.

In order to increase protection against undesired electric shocks, which have occurred, between the rails and tool-holder carts of the prior art, the cart 1 makes a free safety distance of at least 35 mm between the support frame 2 and a rolling plane, defined by the rollers 5 and/or by the wheel 10, and the rolling surface of the rollers 5 and the wheel 10 is made of electrically insulating polymeric material, for example polyamide.

According to a further embodiment, the cart 1 makes a free vertical distance of at least 7.5 cm, preferably of at least 8 cm, between a central portion of the cross rod 7, with a length greater than ⅔ of the total length of the cross rod 7 and a rolling plane defined by the rollers 5 and/or by the wheel 10. In this way, the cart 1 can extend over potential installations arranged between the two rails and partially voluminous upwards.

According to one embodiment (FIG. 12), the wheel 10 comprises two adjacent rolling portions 48 made of polymeric material, for example polyamide, and a counterweight portion 49 made of a material heavier than the material of the rolling portions, for example steel.

The counterweight portion 49 has a radial extension, which is smaller than the radial extension of the two rolling portions 48 to ensure the electrical insulation and not have to work a rolling surface on the counterweight portion 49.

The wheel 10 can further comprise a unilateral insulating plate 50 (inner side of the track) made of electrically insulating polymeric material to avoid electrical contacts on the inner side of the rail.

Figure 12:
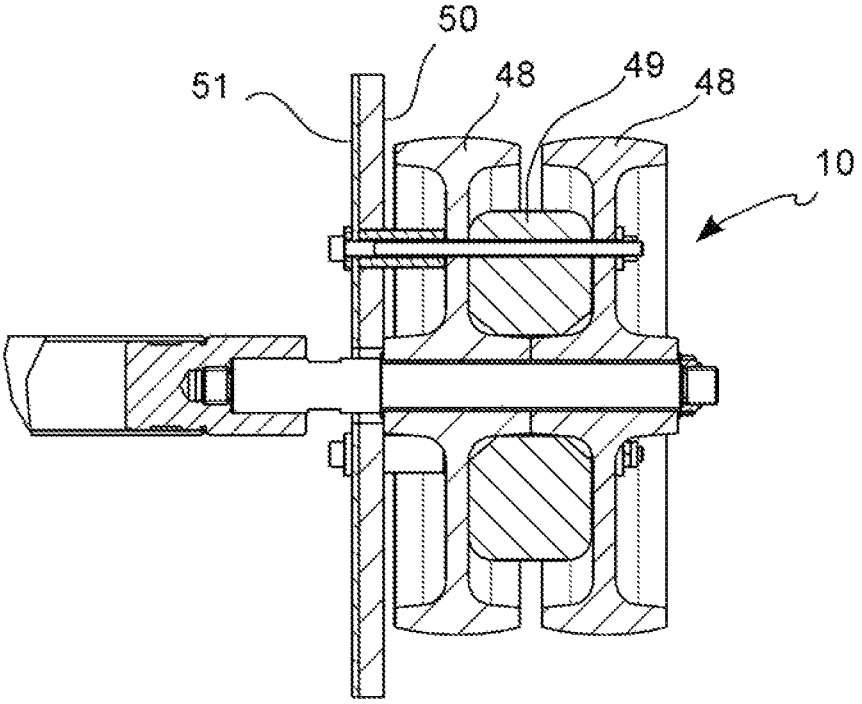
FIG. 12 is a section view of a counterweight and support wheel of the cart according to one embodiment.

Advantageously, the insulating plate 50, in turn, is protected and reinforced from potential knocks by means of a metal reinforcement plate 51 connected on an inner side of the insulating plate 50, opposite the rolling portions 48 (FIG. 12).

Figure 13:
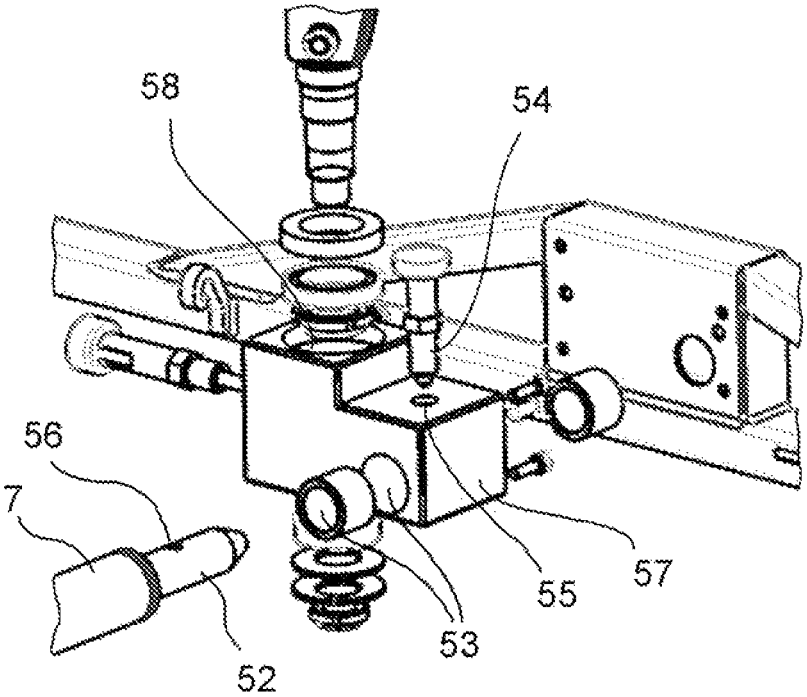
FIGS. 13, 14 and 15 are exploded views of a detail of a support frame of the cart according to one embodiment.

According to one embodiment, the cart 1 comprises rapid coupling means for the coupling between the longitudinal beam 3 and the cross rod 7, for example a male portion 52, formed at the connection end 8 of the cross rod 7, and insertable in a corresponding female seat 53, formed at the longitudinal beam 3, as well as a pin or locking screw 54, insertable or screwable in cross-holes 55, 56 formed in the male portion 52 and in the female seat 53 (FIG. 13).

FIG. 3 illustrates a cart 1 assembly configuration, wherein the support end 9 of the cross rod 7 is removably coupled to a further longitudinal beam 3' with rollers 5', configured in a symmetrical and mirrored manner with respect to the longitudinal beam 3, and which has the function of said one or more wheels 10 and a further anti-overturning function in a longitudinal direction of the rails. In this embodiment, a further tool-holder arm 12' can be provided, connected to the support frame 2 adjacent to the support end 9 of the cross rod 7 and rotating, with respect to the support frame 2, about a further substantially vertical rotation axis 14' in an unlimited open angular range 15.

This allows a modular configuration of the cart 1 for a simultaneous use of one or more tools 17, 17' and for carrying out work on, or close to both of the track rails at the same time.

Figure 14:
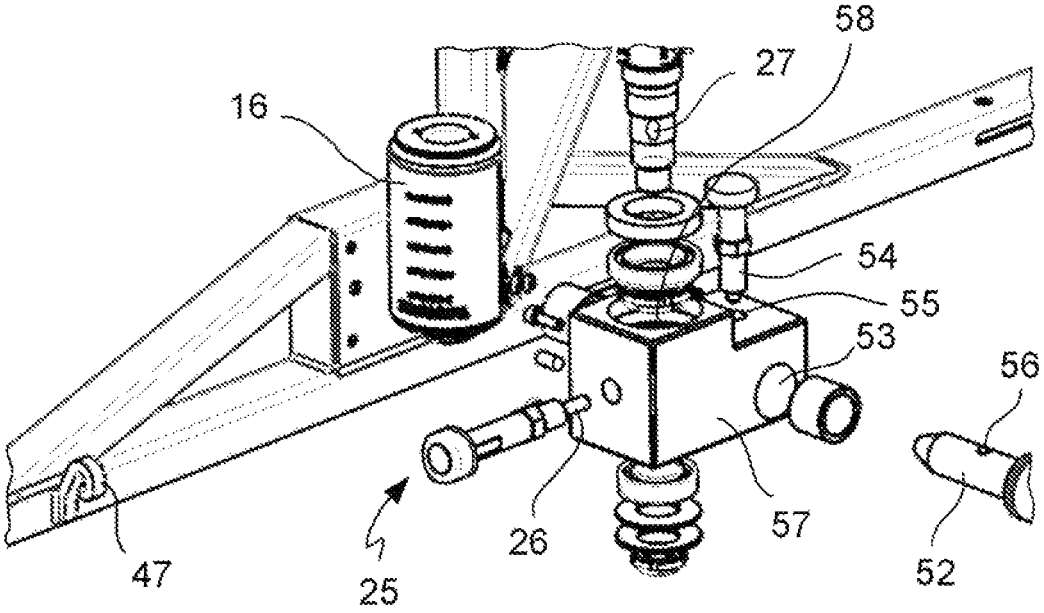
Figure 15:
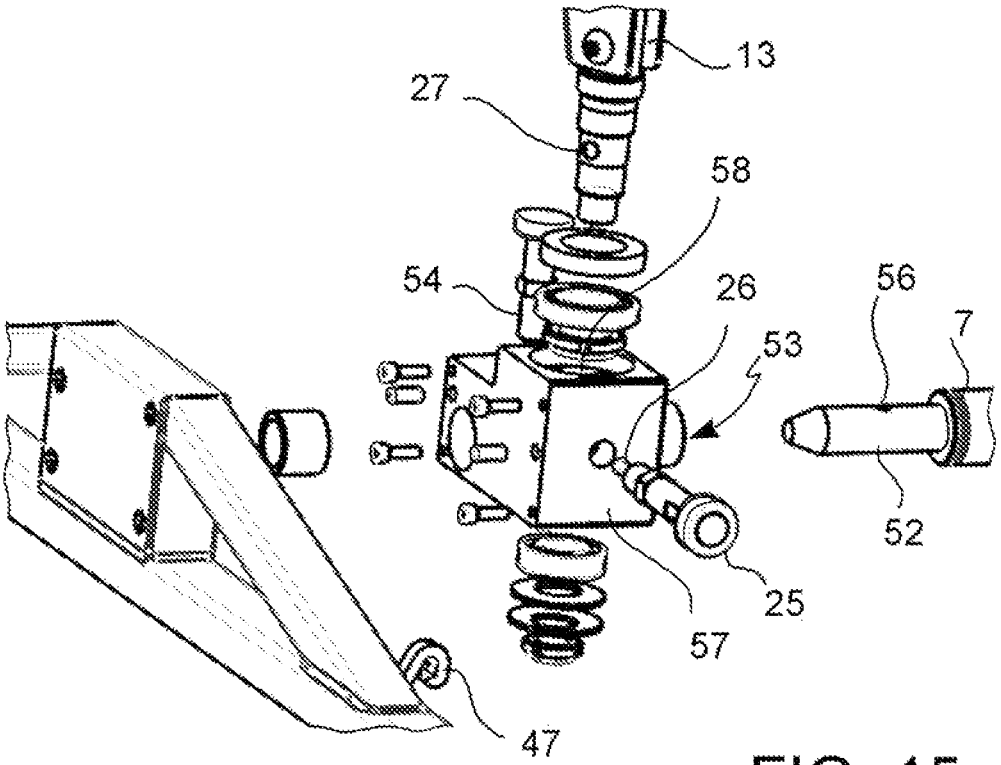

According to a further embodiment, the cart 1 comprises a central mounting block 57, preferably a massive block of aluminum or steel, connectable to the longitudinal beam 3 (preferably, optionally on each of two opposite sides of the longitudinal beam 3), and forming both a seat for the removable coupling of the cross rod 7, for example the female seat 53, and a fulcrum seat 58 for the rotatable connection of the tool-holder arm 12 to the support frame 2 (FIGS. 13, 14, 15).

This allows mechanical precision machining on the longitudinal beam 3 to be reduced or eliminated, concentrating the machining mainly on the central mounting block 57, whose overall dimensions are extremely reduced and therefore, it can be fabricated and worked much more easily, accurately and quickly than a long, bulky beam profile.

Figure 4:
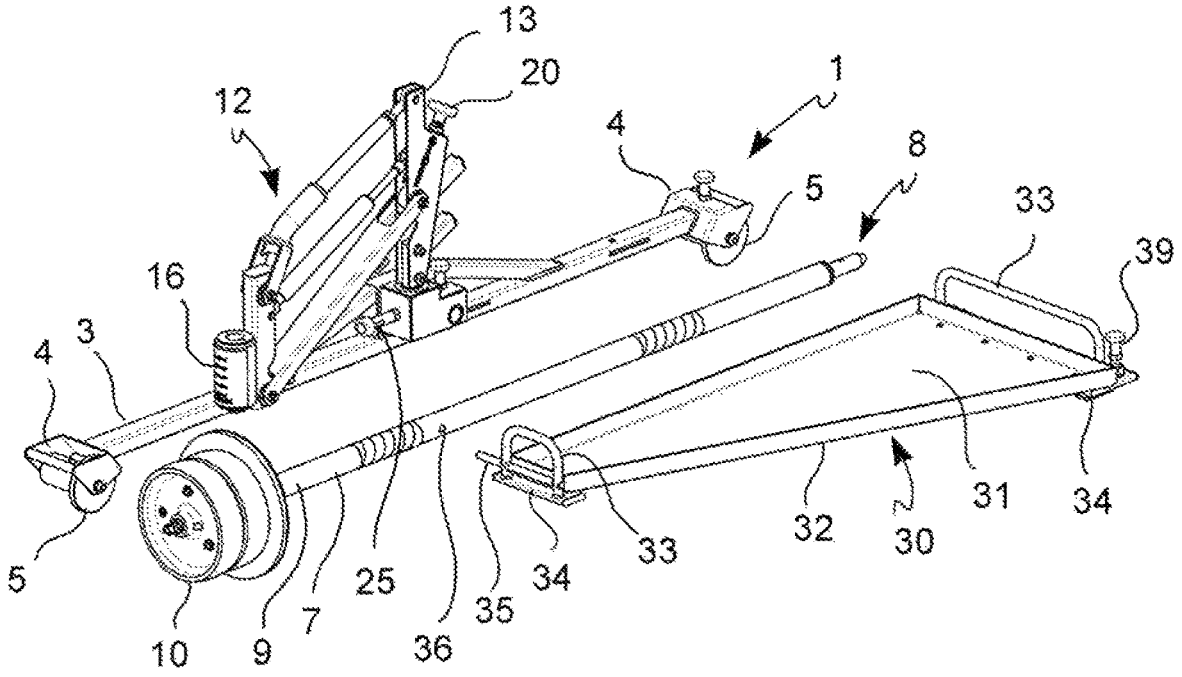
FIG. 4 illustrates a rail tool-holder cart in a disassembled transport configuration, according to one embodiment.

Advantageously, the turret portion 13 can comprise a main body made of metal sheet, for example steel, bent to form two walls, extended in two parallel vertical planes and having a hole in a direction orthogonal to the parallel vertical planes, so as to form a first hinge fork for a rotation of the arm 18 in a vertical plane (FIGS. 4, 5).

Similarly, the arm 18 can comprise a tubular profile with a rectangular section cut so as to form two walls also extended in parallel vertical planes and having a hole in a direction orthogonal to the parallel vertical planes, so as to form a second hinge fork for the rotation of the arm 18 in the vertical plane (FIGS. 4, 5).

This avoids the need of making special hinge portions and welding them to the turret portion 13 and arm elements 18.

Figure 16:
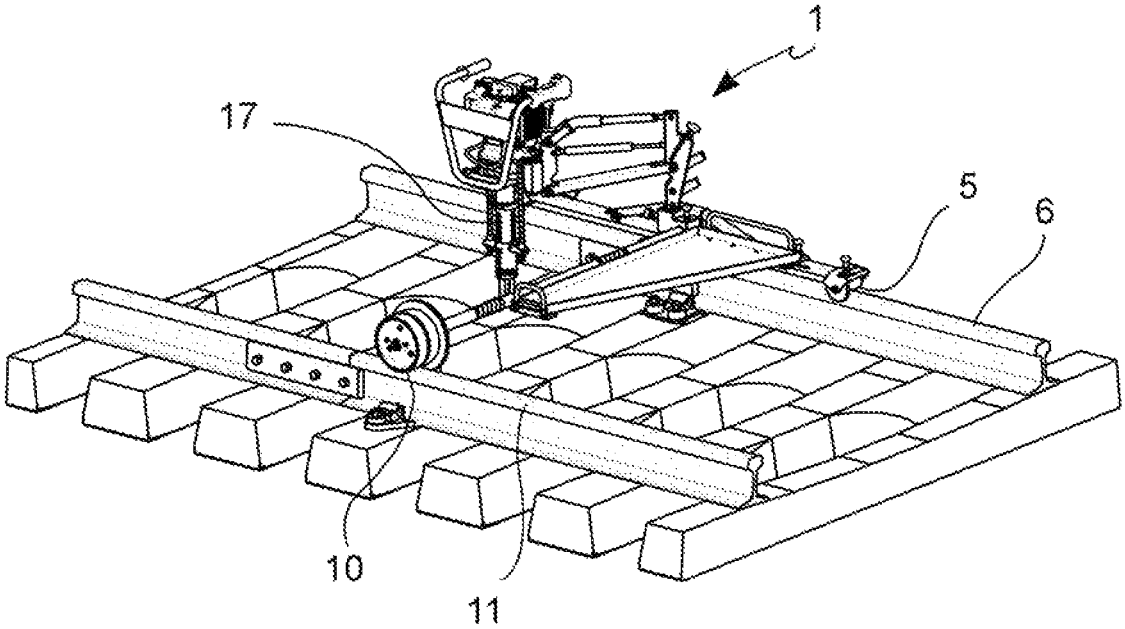
FIG. 16 illustrates the use of the cart with a tool during a vertical screwing and drilling operation, according to one embodiment.

The coupling interface 16 can comprise a tubular profile, which forms a vertical inner seat (FIGS. 3, 14) for insertion, with certain positioning, of a coupling pin of the tool 17, particularly in the case of drills/screwdrivers 17 for making vertical holes/screwing (FIG. 16).

Figure 17:
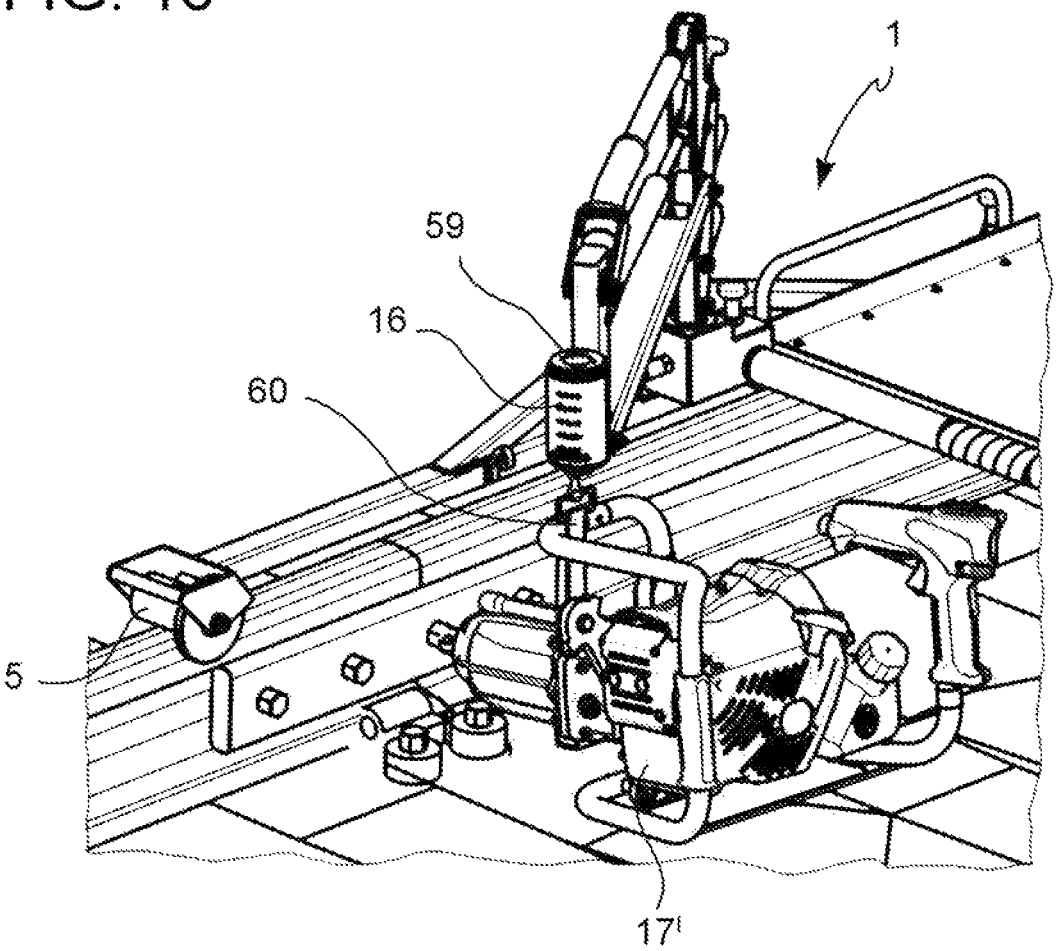
FIG. 17 illustrates the use of the cart with a tool during a horizontal screwing operation, according to one embodiment.

A mushroom pin 59 can be inserted, in the same vertical inner seat, with a strip 60 or cable for hanging a screwdriver 17' from above for screwing in a horizontal direction (FIG. 17).

Figure 18:
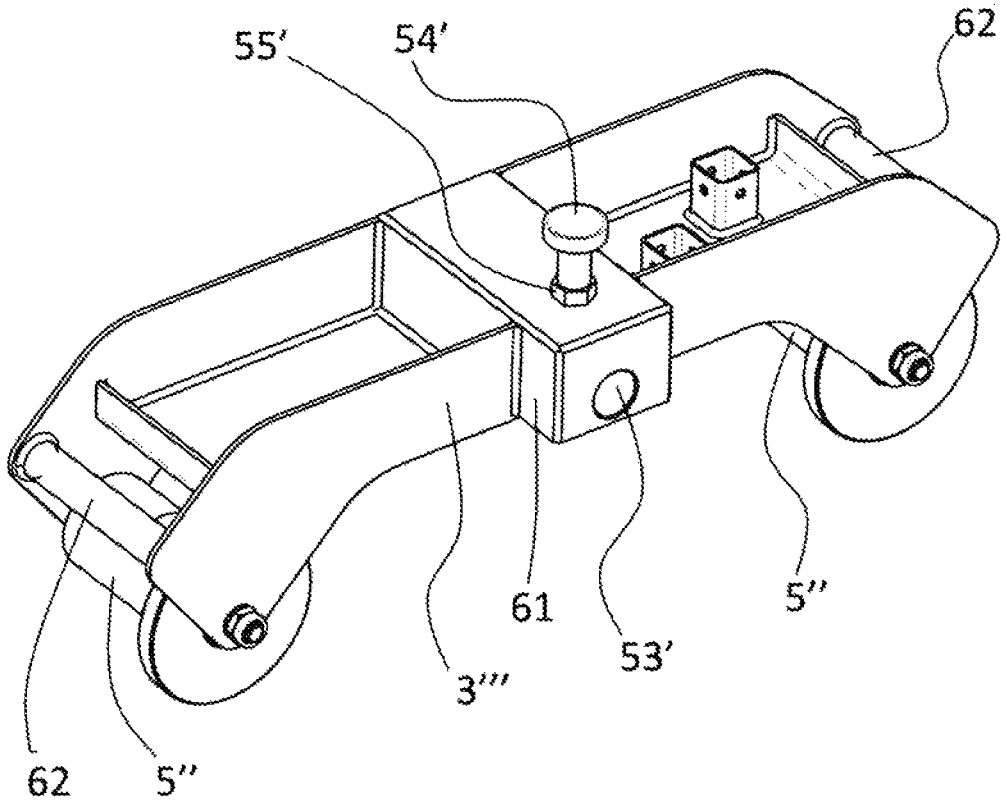
FIG. 18 illustrates a detail of the cart according to a further embodiment.

FIG. 18 illustrates an embodiment of the cart 1, wherein the support end 9 of the cross rod 7 is coupled (preferably in a removable manner) to a longitudinal joist 3", with two rollers 5" positioned at two opposite ends of the longitudinal joist 3", and which has the function of said one or more wheels 10 with a further anti-overturning function in a longitudinal direction of the rails.

Figure 19:
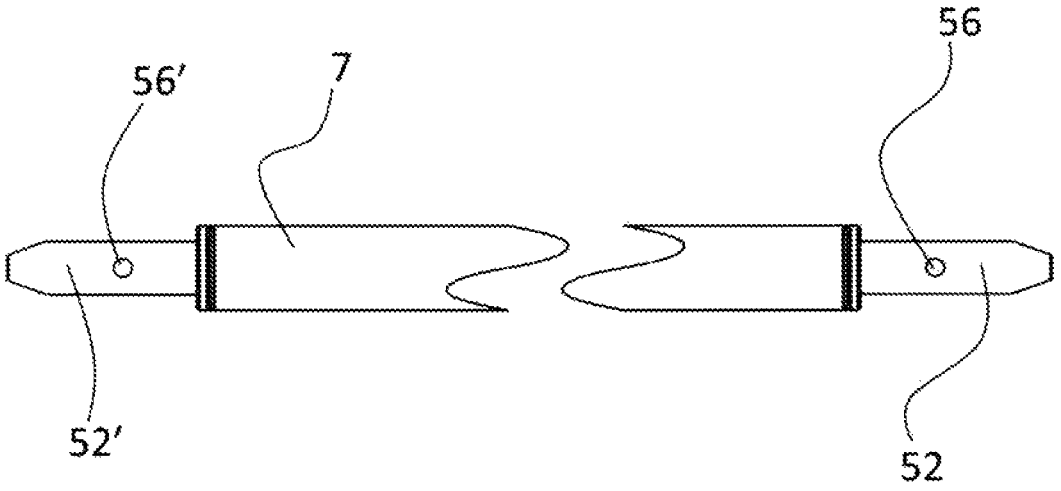
FIG. 19 illustrates a cross rod of the cart according to one embodiment.

The longitudinal joist 3" can be arc-shaped (with the concave side facing downwards), and it can comprise a central mounting portion 61 with a female seat 53' for receiving a male portion 52', formed at the support end 9 of the cross rod 7 (and with a similar, or substantially identical shape to the male portion 52 formed at the connection end 8), as well as a pin or locking screw 54', which can be inserted or screwed in cross-holes 55', 56', formed in the male portion 52' and in the female seat 53' (FIGS. 18, 19).

One or more seats, for example rectangular tubular portions can be formed or fixed, for example welded, to the longitudinal joist 3", for receiving bushes for screw drivers, drill bits or other tool 17, 17' accessories.

The longitudinal joist 3" can form one or more concavities facing upwards, for example due to a "U"-shaped cross section, which allow further counterweights to be received. This is particularly advantageous if the tool 17, 17' is connectable to the coupling interface 16 by means of an extension structure. The extension structure is removably connectable to the coupling interface 16 and has a horizontal extension, so as to increase the range of action of the tool 17, 17'. The extension is not illustrated in the figures, but it is expressly comprised as an embodiment of the invention and can be combined with any one of the embodiments described thus far.

According to one embodiment, the joist 3" forms two elongated handle and protection portions 62 arranged above the rollers 5", which serve as a transport handle and protection for the rollers 5" (which can be made of nylon) in the event of accidental knocks.

Similar elongated handle and protection portions 62 can be arranged above the rollers 5 and/or 5" of the previously described longitudinal beams 3, 3'.

Clearly, a person skilled in the art may make further modifications and variations to the tool-holder cart 1 according to the present invention to satisfy specific and contingent needs, all contained within the protective scope of the invention, as defined by the following claims.

The invention claimed is:

1. A rail tool-holder cart, comprising:

A) a support frame having:

a longitudinal beam having two opposite end portions on each of which a roller is mounted for a rolling support of the support frame at two spaced apart points on a first rail, a cross rod having a connection end rigidly connected to the longitudinal beam in a center region between the two end portions, and a support end opposite the connection end and on which at least one wheel is mounted, for a rolling support of the support frame at at least one point on a second rail transversely spaced apart from the first rail, B) a tool-holder arm comprising:

a turret portion connected to the support frame adjacent to the connection end of the cross rod and rotatable with respect to the support frame about a substantially vertical rotation axis in an unlimited open angular range, a coupling interface for a removable connection of a tool, an arm extended transversely to the vertical rotation axis and which connects the coupling interface to the turret portion so that the coupling interface rotates together with the turret portion around the vertical rotation axis and is vertically movable with respect to the support frame between an upper limit position and a lower limit position, C) a spring exerting on the coupling interface a permanent thrust towards the upper limit position so as to compensate for at least a part of the weight of the tool, D) adjustment means for adjusting the spring thrust on the coupling interface.

2. A cart according to claim 1, wherein the tool-holder arm comprises a structure of rigid rods hinged to one another, deformable on a vertical deformation plane, so as to guide the vertical translation of the coupling interface with respect to the support frame.

3. A cart according to claim 1, wherein:

the spring is interposed in the pre-compressed configuration between the turret portion and the coupling interface, a shock absorber is coupled to the spring.

4. A cart according to claim 1, wherein the adjustment means comprise means for adjusting the spring pre-compression force or for adjusting the position of the spring with respect to the turret portion and to the coupling interface.

5. A cart according to claim 1, wherein the spring comprises a first end connected to the turret portion and a second end connected to the coupling interface, wherein the adjustment means are configured to vary the vertical connection position of at least one of the first and second ends.

6. A cart according to claim 1, comprising stop means operable to lock the tool-holder arm in one or more predetermined angular positions.

7. A cart according to claim 6, wherein said one or more predetermined angular positions comprise an advancement position in which the tool-holder arm is turned towards the support end of the cross rod and is aligned with the cross rod.

8. A cart according to claim 1, wherein the vertical rotation axis is spaced apart from a first rail axis, defined by the rollers, towards a second rail axis, defined by one or more wheels, in a misalignment range of between 1/20 and 1/30 of the distance between the first and the second rail axes.

9. A cart according to claim 1, comprising an auxiliary platform removably connectable to the support frame and adapted to temporarily support a tool.

10. A cart according to claim 9, wherein the auxiliary platform comprises:

a support plane made of metal sheet with peripheral edges bent upwards, two handles positioned at two opposite edges and connected to metal reinforcement profiles connected to the opposite edges of the auxiliary platform.

11. A cart according to claim 9, wherein the auxiliary platform comprises:

a pin arranged at a first handle of the auxiliary platform and adapted to be inserted in a through hole of the support frame, and at least two latches arranged at a second handle of the auxiliary platform and insertable in corresponding slots of the support frame, a locking member adapted to lock the auxiliary platform in the position thereof mounted on the support frame.

12. A cart according to claim 1, wherein at least one of the rollers has one or more recesses engageable by a roller locking pin connected to the support frame for a stationary locking of the cart.

13. A cart according to claim 1, comprising a damping system exerting on the rollers and/or the wheel a braking force which is permanent and adapted to slow down and stop movements of the cart on tracks inclined up to 40 per thousand, which is configured to be overcome by means of a manual thrust of the cart.

14. A cart according to claim 13, wherein the damping system comprises springs acting on the rollers so as to achieve a permanent friction between the rollers and the support frame.

15. A cart according to claim 1, wherein the rollers form a substantially cylindrical rolling surface and a single unilateral flange on the side facing the inside of the first rail.

16. A cart according to claim 1, comprising a plurality of seats for receiving screwdrivers or drill bits.

17. A cart according to claim 1, wherein the cross rod is adjustable in length and comprises means for locking the adjusted length.

18. A cart according to claim 1, wherein the tool-holder arm comprises a hooking portion and the longitudinal beam comprises a corresponding counter-hooking portion engageable with each other to lock the tool-holder arm in a compacted position aligned with and lowered towards the longitudinal beam.

19. A cart according to claim 1, wherein the longitudinal length of the longitudinal beam, including the rollers, is in the range from 0.85 to 1.15 times the length of the cross rod, including the wheel.

20. A cart according to claim 1, wherein the cross rod, including the wheel, is manually transportable and also the longitudinal beam with the tool-holder arm is manually transportable.

21. A cart according to claim 1, wherein:

a free safety distance of at least 35 mm is formed between the support frame and a rolling plane defined by the rollers and by the wheel, the rolling surface of the rollers and of the wheel is made of electrically insulating polymeric material.

22. A cart according to claim 1, wherein a vertical distance of at least 7.5 cm is formed between a central portion of the cross rod and a rolling plane defined by the rollers and by the wheel.

23. A cart according to claim 1, wherein the wheel comprises:

two adjacent rolling portions made of polymeric material, a counterweight portion made of a material heavier than the material of the rolling portions, and having a radial extension lower than the radial extension of the two rolling portions, a unilateral insulating plate made of electrically insulating polymeric material, a metal reinforcement plate connected on an inner side of the insulating plate opposite the rolling portions.

24. A cart according to claim 1, comprising a central mounting block connectable to the longitudinal beam and forming both a seat for the removable coupling of the cross rod and a fulcrum seat for a rotatable connection of the tool-holder arm.

25. A cart according to claim 1, wherein:

the turret portion comprises a main body made of metal sheet, bent to form two walls extended in two parallel vertical planes and having a hole in a direction orthogonal to the parallel vertical planes, so as to form a first hinge fork for a rotation of the arm in a vertical plane, the arm comprises a tubular profile with a rectangular section cut so as to form two walls extended in parallel vertical planes and having a hole in a direction orthogonal to the parallel vertical planes, so as to form a second hinge fork for the rotation of the arm in the vertical plane.

26. A cart according to claim 1, wherein the support end of the cross rod is coupled, in a removable manner, to a longitudinal joist with two rollers positioned at two opposite ends of the longitudinal joist.

* * * * *